US005998126A

United States Patent [19]

Toya et al.

[11] Patent Number: 5,998,126

[45] Date of Patent: Dec. 7, 1999

[54] PHOTOTHERMOGRAPHIC MATERIAL

[75] Inventors: Ichizo Toya; Toru Harada, both of Kanagawa, Japan

[73] Assignee: Fuji Photo Film Co., Ltd., Kanagawa, Japan

[21] Appl. No.: 08/848,468

[22] Filed: May 8, 1997

[30] Foreign Application Priority Data

May 20, 1996 [JP] Japan ..... 8-148656

[51] Int. Cl.[6] ..... G03C 1/498

[52] U.S. Cl. ..... 430/619; 430/568; 430/517; 430/523; 430/945

[58] Field of Search ..... 430/619, 945, 430/568, 517, 523

[56] References Cited

U.S. PATENT DOCUMENTS

| | | | |
|---|---|---|---|
| 4,711,838 | 12/1987 | Grzeskowiak et al. . | |
| 4,868,603 | 9/1989 | Kub | 430/619 |
| 5,264,338 | 11/1993 | Urabe et al. | 430/568 |
| 5,641,617 | 6/1997 | Nishio | 430/522 |
| 5,677,121 | 10/1997 | Tsuzuki . | |
| 5,698,380 | 12/1997 | Toya | 430/350 |

FOREIGN PATENT DOCUMENTS

| | | |
|---|---|---|
| 0179555B1 | 3/1988 | European Pat. Off. . |
| 5113548 | 5/1993 | Japan . |

*Primary Examiner*—Thorl Chea
*Attorney, Agent, or Firm*—Birch, Stewart, Kolasch & Birch, LLP

[57] ABSTRACT

A photothermographic material comprising a photosensitive silver halide emulsion layer on one surface of a support is to be exposed to laser light having a wavelength of less than 700 nm. The silver halide of the emulsion layer has a grain size of 0.01–0.1 $\mu$m. A suitable dye is contained in the emulsion layer such that the layer may have an absorbance of 0.3–1.2 at the exposure wavelength. An image containing minimized interference fringes is obtainable.

12 Claims, No Drawings

PHOTOTHERMOGRAPHIC MATERIAL

BACKGROUND OF THE INVENTION

This invention relates to a photothermographic material and more particularly, to a photothermographic material for laser exposure.

Typical prior art means for outputting the image information of medical diagnosis apparatus such as MRI and X-ray CT involves scanning photosensitive material with a laser beam for exposure. Semiconductor laser diodes featuring high output and stability are commonly used as a light source therefor.

Since a photothermographic system is free of a fixation step of dissolving away silver halide, the photosensitive material used therein must be free of haze. The silver halide grains must be reduced in size in order to minimize haze.

However, a photosensitive material comprising a microparticulate emulsion or having high transparency tends to produce interference fringes as a result of reflection of laser light in the interior of the material. As one solution to interference fringes, JP-B 10735/1994 discloses an improved photosensitive material, which is not successful in extinguishing interference fringes.

Attempts to extinguish interference fringes are also made on the laser scanning exposure system. JP-A 113548/1993 discloses a laser scanning exposure method of scanning a transparent layer with a laser beam at such an offset angle that no interference may occur between reflected light rays from upper and lower interfaces of the transparent layer. Interference fringes are not extinguished where there is more than one layer having a different refractive index from the support.

SUMMARY OF THE INVENTION

An object of the present invention is to provide a novel and improved photothermographic material which can produce an interference fringe-free image when exposed to laser light having a wavelength of less than 700 nm.

According to the present invention, there is provided a photothermographic material comprising a photosensitive silver halide emulsion layer on one surface of a support, which is to be exposed to laser light having a wavelength of less than 700 nm. The silver halide of the photosensitive silver halide emulsion layer has a grain size of up to 0.1 $\mu$m. The photosensitive emulsion layer has an absorbance of at least 0.3 at the exposure wavelength.

Preferably, the photothermographic material is to be exposed by means of a laser scanning exposure apparatus which directs scanning laser light to a surface of the photothermographic material at an angle which is not substantially perpendicular to the surface. Then the photothermographic material produces images with minimized interference fringes. Also preferably, the photothermographic material is to be exposed by means of a laser scanning exposure apparatus which emits scanning laser light in a longitudinal multiple mode. Then the photothermographic material produces images with minimized interference fringes. The photothermographic material may further include at least one layer disposed on another surface of the support remote from the silver halide emulsion layer-bearing surface. The at least one layer should preferably have an absorbance of at least 0.2 at the exposure wavelength.

DETAILED DESCRIPTION OF THE INVENTION

The photothermographic photosensitive material of the invention has at least one photosensitive silver halide emulsion layer on one surface of a support and is to be exposed to laser light having a wavelength of less than 700 nm. More particularly, laser scanning exposure is carried out using a laser light source, preferably a readily available, inexpensive semiconductor laser diode. An appropriate wavelength region of exposure is from 300 nm to less than 700 nm, especially from 550 nm to 690 nm. This wavelength region is selected because little obstruction is encountered in reading a transmission image even when a sensitizing dye or a dyestuff having $\lambda$max in this wavelength region is left in the photothermographic material.

The photosensitive silver halide emulsion layer, which is often referred to as a photosensitive emulsion layer, contains a silver halide having a grain size of up to 0.1 $\mu$m. The grain size of silver halide is described later in detail.

The photosensitive emulsion layer should have an absorbance of at least 0.3, preferably 0.3 to 1.2 at the exposure wavelength. The absorbance is determined by coating a photosensitive emulsion layer on one surface of a support to form a sample, placing the sample relative to a light source such that the emulsion layer surface faces the light source, measuring the absorbance of the sample, and subtracting the absorbance of the support as a reference therefrom. Absorbance measurement can also be done using a sample having a protective layer formed on the photosensitive emulsion layer.

Where the photothermographic material of the invention has a plurality of photosensitive emulsion layers, all the photosensitive emulsion layers should preferably satisfy the above-defined ranges of silver halide grain size and absorbance. Where a plurality of photosensitive emulsion layers are present, the overall absorbance is determined using a sample in which photosensitive emulsion layers of the same construction as in the photothermographic material are formed on one surface of a support. The absorbance can also be determined by preparing a corresponding plurality of samples each having one photosensitive emulsion layer.

Where the photothermographic material of the invention has a photosensitive emulsion layer on each surface of a support, the absorbance of the photosensitive emulsion layers is determined by preparing two samples in each of which photosensitive emulsion layers of the same construction as on side surface of the photothermographic material are formed on one surface of a support.

As mentioned in the preamble, interference fringes are more likely to occur as silver halide grains in the photosensitive emulsion layer are reduced in size. By limiting the absorbance of the photosensitive emulsion layer within the specific range, the occurrence of interference fringes can be inhibited. In contrast, interference fringes can occur when the absorbance of the photosensitive emulsion layer is less than 0.3.

The benefits of the invention become more outstanding when the photothermographic material has a photosensitive emulsion layer on one surface of a support, a protective layer on the photosensitive emulsion layer, and a back layer on the other surface of the support such that there may be a difference in refractive index among the layers. Where there are plural interfaces between layers having different refractive indices, plural sets of interference fringes can result from reflection at the respective interfaces. It is then very difficult to take a countermeasure for each layer. It is thus strongly desired to tailor the photosensitive emulsion layer so as to overcome this problem. It is noted that the refractive index is measured by a refractometer, for example, an Abbe's refractometer using a sodium lamp. The above-mentioned problem is likely to arise when the difference of refractive index is about 0.005 to about 0.02, especially about 0.01 to about 0.03.

Preferably the photosensitive material of the invention has a back layer, which should preferably have an absorbance of at least 0.2, especially from 0.3 to 2 at the exposure wavelength. The effect of prohibiting interference fringes is enhanced by forming a back layer of such nature. Preferably there is formed at least one back layer. Where a plurality of back layers are present, at least one layer should satisfy the absorbance requirement, and preferably all the back layers satisfy the absorbance requirement. The absorbance of the back layer can be determined in the same manner as that of the photosensitive emulsion layer.

In the practice of the invention, exposure is preferably laser scanning exposure.

That is, the photothermographic material is preferably exposed by means of a laser scanning exposure apparatus which directs scanning laser light to a surface of the photothermographic material at an angle which is not substantially perpendicular to the surface. By the term "not substantially perpendicular" it is meant that the angle of scanning laser light (relative to the photothermographic material surface) which is closest to a perpendicular line is deviated from a perpendicular line by the range of 3° to 45°, more preferably 5° to 25°, further preferably 7° to 20°, most preferably 10° to 18°.

When photosensitive material is scanned with a laser light beam, the laser beam defines a beam spot on the photothermographic material surface which preferably has a diameter of up to 200 μm, especially up to 100 μm. A smaller beam spot diameter is more effective for reducing the deviation angle of the incident laser beam from a normal. The lower limit of the beam spot diameter is usually 10 μm. Multiple exposure at the same point is acceptable. The effect of inhibiting interference fringes is enhanced by carrying out laser scanning exposure as mentioned above.

Also preferably, exposure is done by means of a laser scanning exposure apparatus which emits scanning laser light in a longitudinal multiple mode because the development of interference fringes is further inhibited as compared with scanning laser light of the longitudinal single mode. The longitudinal multiple mode can be obtained, for example, by wave synthesis, utilization of return light, and high frequency superposition. The longitudinal multiple mode means that the exposure wavelength is not single and usually indicates that the distribution of exposure wavelength is at least 5 nm, more preferably at least 10 nm. The upper limit of exposure wavelength distribution is usually about 60 nm though not critical.

In order that the photosensitive emulsion layer have an absorbance of at least 0.3 at the exposure wavelength according to the invention, dyes having λmax at the exposure wavelength may be used.

The preferred dyes which can be used herein are shown below.

First, compounds of the following general formula (1) are preferred.

(1)

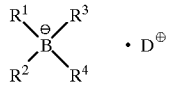

In formula (1), $R^1$, $R^2$, $R^3$ and $R^4$ are independently an alkyl, aryl, aralkyl, alkenyl, alkynyl, silyl or heterocyclic group, and $D^+$ is a cationic dye.

Also, compounds of the following general formulae (2) and (3) may be used in combination.

$$X^{\ominus}\cdot D^{\oplus} \quad (2)$$

In formula (2), $X^-$ is an anion and $D^+$ is a cationic dye.

(3)

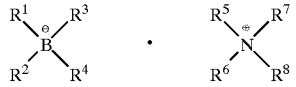

In formula (3), $R^1$, $R^2$, $R^3$ and $R^4$ are independently an alkyl, aryl, aralkyl, alkenyl, alkynyl, silyl or heterocyclic group, and $R^5$, $R^6$, $R^7$ and $R^8$ are independently a hydrogen atom, alkyl, aryl, aralkyl, alkenyl, alkynyl or heterocyclic group.

Further preferred are compounds of the following general formulae (4) and (5). These compounds may be used alone or in combination with the compound of formula (3).

(4)

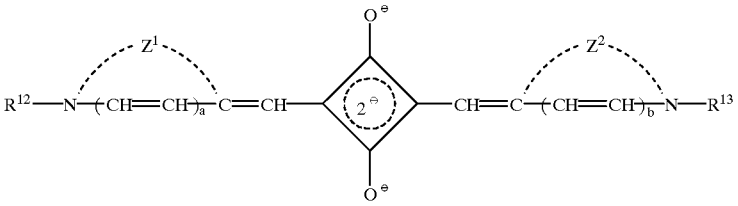

In formula (4), each of $Z^1$ and $Z^2$ is a group of non-metallic atoms necessary to form a 5- or 6-membered nitrogenous heterocycle which may have a fused ring; each of $R^{12}$ and $R^{13}$ is an alkyl, alkenyl or aralkyl group; and letters a and b each are equal to 0 or 1.

(5)

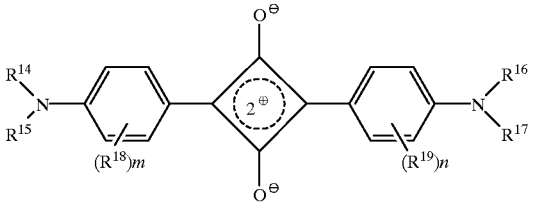

In formula (5), each of $R^{14}$, $R^{15}$, $R^{16}$, and $R^{17}$ is a hydrogen atom, alkyl, aryl or aralkyl group, each of $R^{18}$ and $R^{19}$ is a hydrogen atom, halogen atom, alkyl, alkoxy, amino or hydroxyl group, or $R^{14}$ and $R^{15}$, $R^{16}$ and $R^{17}$, $R^{14}$ and $R^{18}$, $R^{15}$ and $R^{18}$, $R^{16}$ and $R^{19}$, or $R^{17}$ and $R^{19}$, taken together, may form a five- or six-membered ring, letters m and n each are an integer of 1 to 4.

The general formula (1) is described in detail. B represents a boron atom. The alkyl groups represented by $R^1$ to $R^4$ are those groups having 1 to 12 carbon atoms, more preferably 1 to 8 carbon atoms, for example, methyl, ethyl, propyl, butyl, hexyl and octyl. The alkyl groups may have substituents, for example, hydroxyl, halogen atoms (e.g., F, Cl and Br), methoxy and carboxyl. The aryl group represented by $R^1$ to $R^4$ is preferably phenyl, which may have a substituent such as methyl, methoxy and halogen atoms (e.g., F, Cl and Br). The aralkyl groups represented by $R^1$ to $R^4$ are, for example, benzyl and phenethyl. The alkenyl groups represented by $R^1$ to $R^4$ are those groups having 2 to 6 carbon atoms, for example, 2-pentenyl, vinyl, allyl, 2-butenyl, 1-propenyl and 2-propenyl. The alkynyl groups represented by $R^1$ to $R^4$ are, for example, ethynyl and 2-propynyl. The heterocyclic groups represented by $R^1$ to $R^4$ are, for example, pyrrolyl, pyridyl, and pyrrolidinyl. The silyl groups represented by $R^1$ to $R^4$ are of $SiR^9R^{10}R^{11}$ wherein $R^9$, $R^{10}$ and $R^{11}$ are alkyl or aryl groups (both as defined above). Preferred groups represented by $R^1$ to $R^4$ are alkyl, aralkyl and aryl groups.

Examples of the cation dye $D^+$ include the cyanine, Rhodamine, Methylene Blue and Safranine dyes described in JP-A 150242/1987, the cyanine, polymethine, and pyrylium dyes described in JP-A 188635/1993, the cyanine, azomethine, styryl, xanthene, and azine dyes described in JP-A 19734/1982, the cyanine, xanthene and styryl dyes described in JP-A 13144/1989, the cyanine dyes described in JP-A 88444/1989, the triarylmethane dyes described in JP-A 150070/1995, the tetrazine and diimonium dyes described in JP-A 146905/1992, and the xanthene, thioxanthene, oxazine, thiazine, cyanine, diphenylmethane, triphenylmethane, and pyrylium dyes described in JP-A 59110/1993.

Preferred among others are cyanine dyes of the following general formula (6).

(6)

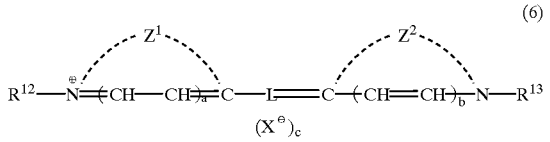

In formula (6), $Z^1$ and $Z^2$ each are a group of non-metallic atoms necessary to form a 5- or 6-membered nitrogenous eterocycle which may have a fused ring; $R^{12}$ and $R^{13}$ each are alkyl, alkenyl or aralkyl; L is a linking group comprising 3 or 5 methine groups connected through a conjugated double bond; and letters a, b and c each are equal to 0 or 1.

More illustratively, examples of the 5- or 6-membered nitrogenous heterocycle represented by $Z^1$ and $Z^2$ in formula (6) include oxazole, isooxazole, benzoxazole, naphthoxazole, thiazole, benzothiazole, naphthothiazole, indolenine, benzo-indolenine, imidazole, benzoimidazole, naphthoimidazole, quinoline, pyridine, pyrrolopyridine, furopyrrole, indolidine, and imidazoquinoxaline rings. Preferred are 5-membered nitrogenous heterocycles having a benzene or naphthalene ring fused thereto. These rings may have a substituent. Exemplary substituents include lower alkyl (e.g., methyl and ethyl), alkoxy (e.g., methoxy and ethoxy), phenoxy (e.g., unsubstituted phenoxy and p-chlorophenoxy), halogen atoms (e.g., Cl, Br and F), alkoxycarbonyl (e.g., ethoxycarbonyl), cyano and nitro.

The alkyl, alkenyl and aralkyl groups represented by $R^{12}$ and $R^{13}$ have the same meaning as the alkyl, alkenyl and aralkyl represented by $R^1$ to $R^4$ in formula (1). L is a linking group comprising 3 or 5 methine groups connected through a conjugated double bond. The methine groups may have substituents such as alkyl (as defined above), halogen atoms (e.g., F, Cl and Br), aryl (as defined above), $NR^{20}R^{21}$, $SR^{22}$ and $OR^{23}$ wherein $R^{20}$, $R^{21}$, $R^{22}$ and $R^{23}$ are alkyl (as defined above) or aryl (as defined above) or $R^{20}$ and $R^{21}$ taken together, may form a 5- or 6-membered ring.

Referring to the general formula (2) again, $X^-$ represents an anion, for example, halide ions (e.g., $Cl^-$ $Br^-$ and $I^-$), $ClO_4^-$, $PF_6^-$, $SbF_6^-$, $BF_4^-$, p-toluenesulfonate ion, and ethylsulfate ion. The cationic dye represented by $D^+$ are the same as the cationic dye as described for formula (1).

The general formula (3) is described in detail. The alkyl, aryl, aralkyl, alkenyl, alkynyl, silyl and heterocyclic groups represented by $R^1$, $R^2$, $R^3$ and $R^4$ have the same meaning as the alkyl, aryl, aralkyl, alkenyl, alkynyl, silyl and heterocyclic groups represented by $R^1$, $R^2$, $R^3$ and $R^4$ in formula (1). The alkyl, aryl, aralkyl, alkenyl, alkynyl and heterocyclic groups represented by $R^5$, $R^6$, $R^7$ and $R^8$ have the same meaning as the alkyl, aryl, aralkyl, alkenyl, alkynyl and heterocyclic groups represented by $R^1$, $R^2$, $R^3$ and $R^4$ in formula (1).

Illustrative non-limiting examples of the compound of general formula (3) include tetramethylammonium n-butyltriphenylboron,
tetramethylammonium n-butyltrianisilboron,
tetramethylammonium n-octyltriphenylboron,
tetramethylammonium n-octyltrianisilboron,
tetraethylammonium n-butyltriphenylboron,
tetrabutylammonium n-butyltriphenylboron,
tetraoctylammonium n-octyltriphenylboron,
tetrabutylammonium n-dodecyltriphenylboron,
trimethylhydrogenammonium n-butyltriphenylboron,
tetrahydrogenammonium n-butyltriphenylboron,
tetramethylammonium tetrabutylboron,
tetra-n-butylammonium tetra-n-butylboron,
tetramethylanmonium tri-n-butyl(triphenylsilyl)boron,
tetramethylammonium tri-n-butyl(dimethylphenylsilyl) boron,
tetraethylammonium n-octyldiphenyl(di-n-butylphenylsilyl)-boron,
tetramethylammonium dimethylphenyl(trimethylsilyl) boron,
tetramethylammonium benzyltriphenylboron,
tetrabutylammonium benzyltriphenylboron,
tetramethylammonium methyltriphenylboron, and
tetramethylammonium tri-n-butylphenylboron. These compounds may be used alone or in admixture of two or more.

The general formula (4) is described in detail. The nitrogenous heterocyclic rings represented by $Z^1$ and $Z^2$ have the same meaning as the nitrogenous heterocyclic rings represented by $Z^1$ and $Z^2$ in formula (6). The alkyl, alkenyl and aralkyl groups represented by $R^{12}$ and $R^{13}$ have the same meaning as the alkyl, alkenyl and aralkyl represented by $R^1$ to $R^4$ in formula (6). Letters a and b each are equal to 0 or 1.

The general formula (5) is described in detail. The alkyl, aryl and aralkyl groups represented by $R^{14}$, $R^{15}$, $R^{16}$, $R^{17}$, $R^{18}$ and $R^{19}$ have the same meaning as the alkyl, aryl and aralkyl represented by $R^1$ to $R^4$ in formula (1). The halogen atoms represented by $R^{18}$ and $R^{19}$ are F, Cl and Br. The alkoxy groups represented by $R^{18}$ and $R^{19}$ include methoxy and ethoxy groups. The amino groups represented by $R^{18}$ and $R^{19}$ include methylamino, dimethylamino, acetylamino, methanesulfonamide, and benzamide groups. The five- or six-membered rings formed by $R^{14}$ and $R^{15}$, $R^{16}$ and $R^{17}$, $R^{14}$ and $R^{18}$, $R^{15}$ and $R^{18}$, $R^{16}$ and $R^{19}$, or $R^{17}$ and $R^{19}$, taken together, include 1,2,3,4-tetrahydroquinoline and durolidine rings.

The compounds of formulae (4) and (5) may be used alone or in combination with the compounds of formula (3).

Illustrative non-limiting examples of the compound according to the invention are shown below on the basis of the general formula (1). Note that Ph is phenyl, t-$C_4H_9$ is tert-$C_4H_9$, and —$C_4H_9$(n) is normal —$C_4H_9$.

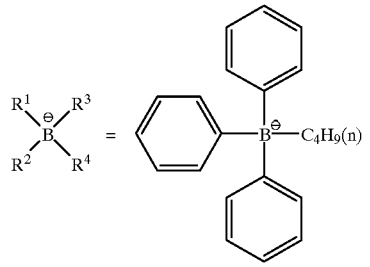

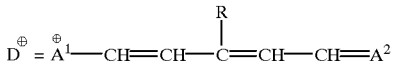

| compound | $A^1$ | $A^2$ | R |
|---|---|---|---|
| 1 | 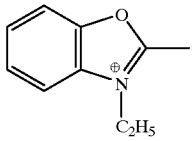 | 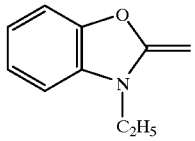 | H |
| 2 | 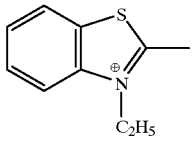 | 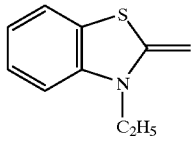 | Cl |
| 3 | 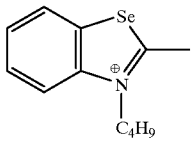 | 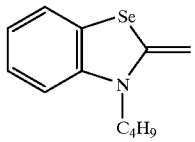 | H |
| 4 | 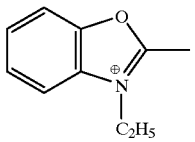 | 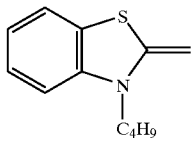 | Cl |

compound 5

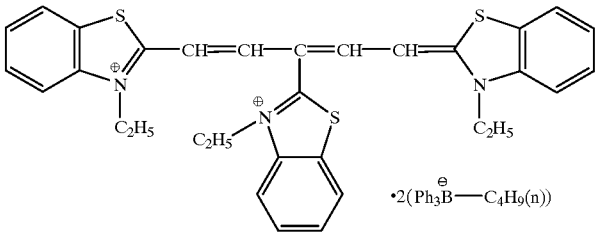

-continued
compound 6
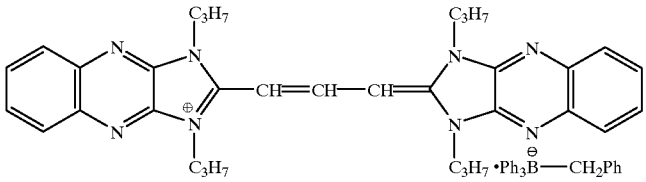
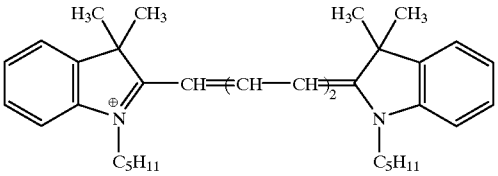
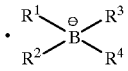
| compound | $R^1$ | $R^2$ | $R^3$ | $R^4$ |
|---|---|---|---|---|
| 7 | Ph | Ph | Ph | n-$C_4H_9$ |
| 8 | t-$C_4H_9$ | t-$C_4H_9$ | t-$C_4H_9$ | $CH_2Ph$ |
| 9 | F | F | F | n-$C_4H_9$ |
| 10 | $CH_3O$ | $CH_3O$ | $CH_3O$ | n-$C_4H_9$ |
| 11 | $CH_3$ | $CH_3$ | $CH_3$ | —$CH_2$—Ph |
| 12 | n-$C_4H_9$ | n-$C_4H_9$ | n-$C_4H_9$ | n-$C_4H_9$ |
| 13 | n-$C_4H_9$ | n-$C_4H_9$ | n-$C_4H_9$ | —$Si(CH_3)_2Ph$ |
| 14 | n-$C_4H_9$ | n-$C_4H_9$ | n-$C_4H_9$ | —$SiPh_3$ |
| 15 | $CH_3$ | $CH_3$ | Ph | —$Si(CH_3)_3$ |
| 16 | Ph | Ph | Ph | —$CH_2$—CH=$CH_2$ |
| 17 | Ph | Ph | Ph | —CH=$CH_2$ |
| 18 | Ph | Ph | Ph | —$CH_2$—C≡CH |
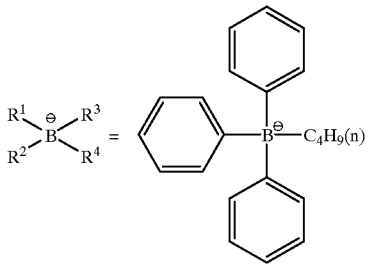
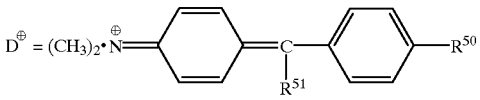

-continued
| compound | $R^{50}$ | $R^{51}$ |
|---|---|---|
| 19 | H | 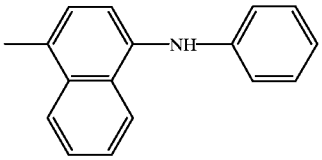 |
| 20 | $N(CH_3)_2$ | 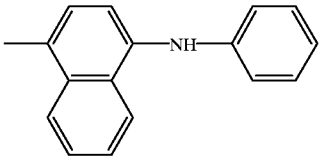 |
| 21 | $N(CH_3)_2$ | 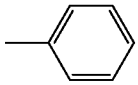 |
| 22 | $N(CH_3)_2$ | 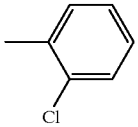 |
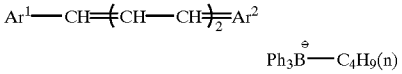
| compound | $Ar^1$ | $Ar^2$ |
|---|---|---|
| 23 | 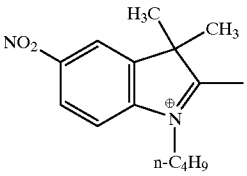 | 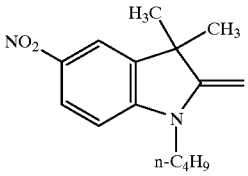 |
| 24 | 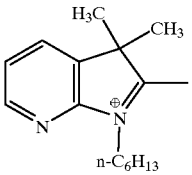 | 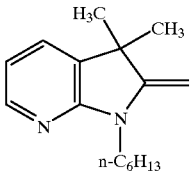 |
| 25 | 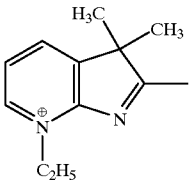 | 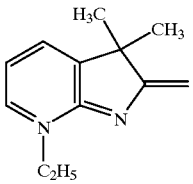 |

-continued

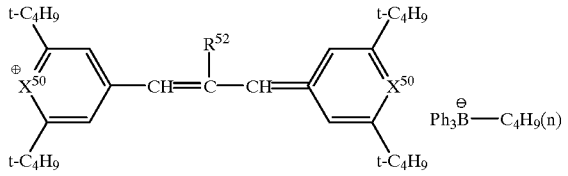

| compound | $X^{50}$ | $R^{52}$ |
|---|---|---|
| 26 | O | H |
| 27 | O | Ph |
| 28 | S | H |

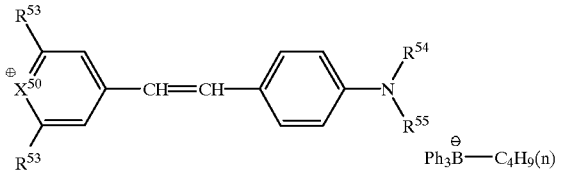

| compound | $X^{51}$ | $R^{53}$ | $R^{54}$ | $R^{55}$ |
|---|---|---|---|---|
| 29 | S | t-$C_4H_9$ | $C_2H_4CN$ | $C_2H_4Cl$ |
| 30 | O | Ph | $C_2H_5$ | $C_2H_5$ |
| 31 | S | Ph | $C_2H_5$ | $C_2H_5$ |

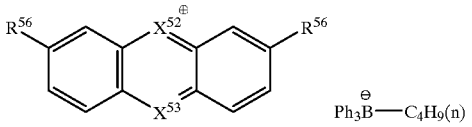

| compound | $X^{52}$ | $X^{53}$ | $R^{56}$ |
|---|---|---|---|
| 32 | S | N | $N(C_2H_5)_2$ |
| 33 | O | N | $N(C_2H_5)_2$ |

Illustrative examples of the compound of the general formula (2) are given by attaching a $X^-$anion to the $D^{30}$ portion of the above-exemplified compounds of the general formula (1). Illustrative examples of the compound of the general formula (3) are as previously mentioned. Illustrative examples of the compounds of the general formulae (4) and (5) are given below.

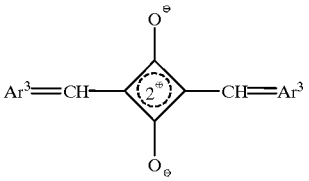

| compound | $Ar^3$ |
|---|---|
| 34 | 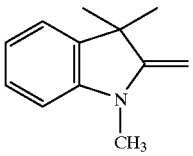 |

-continued

| | |
|---|---|
| 35 | 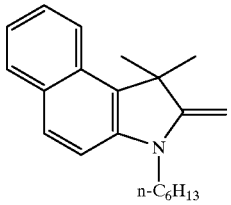 |
| 36 | 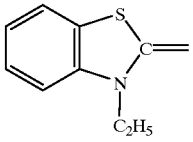 |
| 37 | 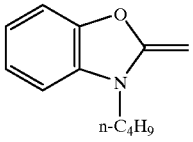 |

-continued

38

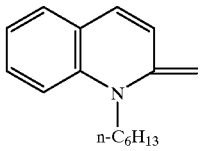

39

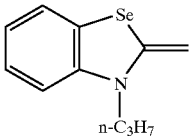

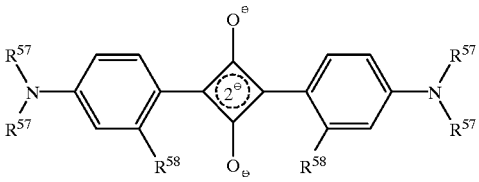

| compound | $R^{57}$ | $R^{58}$ |
|---|---|---|
| 40 | $C_2H_5$ | H |
| 41 | $C_2H_5$ | $CH_3$ |
| 42 | $C_2H_5$ | $NHCOCH_3$ |
| 43 | n-$C_4H_9$ | OH |
| 44 | n-$C_8H_{17}$ | $NHCOC_4H_9$—n |

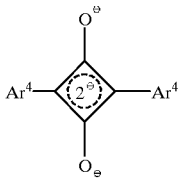

| compound | $Ar^4$ |
|---|---|
| 45 | 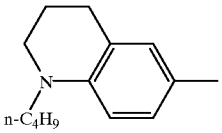 |
| 46 | 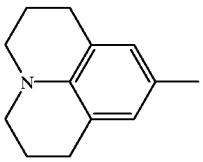 |

These dyes are added to the photosensitive emulsion layer in such amounts that the layer may have an absorbance of at least 0.3 at the exposure wavelength. The dyes may be used alone or in admixture of two or more, with some appropriate combinations being previously mentioned. The dyes may be used by adding to a coating solution for the photosensitive emulsion layer. An appropriate amount of the dye added is about 1 mg to about 2 grams per square meter of the photosensitive material. Combined use with another dye as typified by bis[2-(3,5-di-tert-butyl-o-benzoquinone-monoimide)-4,6-di-tert-butylphenolato]calcium (II) is also acceptable.

It can happen that in the event, some of the above-defined dyes be coincident with spectral sensitizing dyes to be described later or their absorption characteristics be approximate to those of the spectral sensitizing dyes. However, the spectral sensitizing dyes make little contribution to the absorbance of the photosensitive emulsion layer since they are adsorbed to the silver halide.

Silver Halide

A method for forming a photosensitive silver halide is well known in the art. Any of the methods disclosed in Research Disclosure No. 17029 (June 1978) and U.S. Pat No. 3,700,458, for example, may be used. Illustrative methods which can be used herein are a method of adding a halogen-containing compound to a pre-formed organic silver salt to convert a part of silver of the organic silver salt into photosensitive silver halide and a method of adding a silver-providing compound and a halogen-providing compound to a solution of gelatin or another polymer to form photosensitive silver halide grains and mixing the grains with an organic silver salt. The latter method is preferred in the practice of the invention.

The photosensitive silver halide should preferably have a smaller grain size for the purpose of minimizing white turbidity after image formation. Specifically, the grain size is up to 0.1 $\mu$m, preferably 0.01 $\mu$m to 0.08 $\mu$m, most preferably 0.02 $\mu$m to 0.06 $\mu$m. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the plane indices (Miller indices) of an outer surface of silver halide grains. Preferably silver halide grains have a high proportion of {100} plane featuring high spectral sensitization efficiency upon adsorption of a spectral sensitizing dye. The proportion of {100} plane is preferably at least 50%, more preferably at least 65%, most preferably at least 80%. Note that the proportion of Miller index {100} plane can be determined by the method described in T. Tani, J. Imaging Sci., 29, 165 (1985), utilizing the adsorption dependency of {111} plane and {100} plane upon adsorption of a sensitizing dye.

The halogen composition of photosensitive silver halide is not critical and may be any of silver chloride, silver chlorobromide, silver bromide, silver iodobromide, silver iodochlorobromide, and silver iodide. Silver bromide or silver iodobromide is preferred in the practice of the invention. Most preferred is silver iodobromide preferably having a silver iodide content of 0.1 to 40 mol %, especially 0.1 to 20 mol %. The halogen composition in grains may have a uniform distribution or a non-uniform distribution wherein the halogen concentration changes in a stepped or continuous manner. Preferred are silver iodobromide grains having a higher silver iodide content in the interior. Silver halide grains of the core/shell structure are also useful. Such core/shell grains preferably have a multilayer structure of 2 to 5 layers, more preferably 2 to 4 layers.

Preferably the photosensitive silver halide grains used herein contain at least one complex of a metal selected from the group consisting of rhodium, rhenium, ruthenium, osmium, iridium, cobalt, and iron. The metal complexes may be used alone or in admixture of two or more complexes of a common metal or different metals. An appropriate content of the metal complex is $1\times10^{-9}$ to $1\times10^{-2}$ mol, more preferably $1\times10^{-8}$ to $1\times10^{-4}$ mol per mol of silver. Illustrative metal complex structures are those described in JP-A 225449/1995. Preferred among cobalt and iron complexes are hexacyano metal complexes. Illustrative, non-limiting examples of cobalt and iron complexes include hexacyano metal complexes such as $[Fe(CN)_6]^{4-}$, $[Fe(CN)_6]^{3-}$, and $[Co(CN)_6]^{3-}$. The distribution of the metal complex in silver halide grains is not critical. That is, the metal complex may be contained in silver halide grains to form a uniform phase or at a high concentration in either the core or the shell.

Photosensitive silver halide grains may be desalted by any of well-known water washing methods such as noodle and flocculation methods although silver halide grains may be either desalted or not according to the invention.

The photosensitive silver halide grains used herein should preferably be chemically sensitized. Preferred chemical sensitization methods are sulfur, selenium, and tellurium sensitization methods which are well known in the art. Also useful are a noble metal sensitization method using compounds of gold, platinum, palladium, and iridium and a reduction sensitization method. In the sulfur, selenium, and tellurium sensitization methods, any of compounds well known for the purpose may be used. For example, the compounds described in JP-A 128768/1995 are useful. Exemplary tellurium sensitizing agents include diacyltellurides, bis(oxycarbonyl)tellurides, bis(carbamoyl) tellurides, bis(oxycarbonyl)ditellurides, bis(carbamoyl) ditellurides, compounds having a P═Te bond, tellurocarboxylic salts, Te-organyltellurocarboxylic esters, di(poly) tellurides, tellurides, telluroles, telluroacetals, tellurosulfonates, compounds having a P—Te bond, Te-containing heterocyclics, tellurocarbonyl compounds, inorganic tellurium compounds, and colloidal tellurium. The preferred compounds used in the noble metal sensitization method include chloroauric acid, potassium chloroaurate, potassium aurithiocyanate, gold sulfide, and gold selenide as well as the compounds described in U.S. Pat. No. 2,448,060 and UKP 618,061. Illustrative examples of the compound used in the reduction sensitization method include ascorbic acid, thiourea dioxide, stannous chloride, aminoiminomethane-sulfinic acid, hydrazine derivatives, boran compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

According to the invention, the photosensitive silver halide is preferably used in an amount of 0.01 to 0.5 mol, more preferably 0.02 to 0.3 mol, most preferably 0.03 to 0.25 mol per mol of the organic silver salt. With respect to a method and conditions of admixing the separately prepared photosensitive silver halide and organic silver salt, there may be used a method of admixing the separately prepared photosensitive silver halide and organic silver salt in a high speed agitator, ball mill, sand mill, colloidal mill, vibratory mill or homogenizer or a method of preparing an organic silver salt by adding a preformed photosensitive silver halide at any timing during preparation of an organic silver salt. Any desired mixing method may be used insofar as the benefits of the invention are fully achievable.

Organic Silver Salt

The organic silver salt used herein is relatively stable to light, but forms a silver image when heated at 80° C. or higher in the presence of an exposed photocatalyst (as typified by a latent image of photosensitive silver halide) and a reducing agent. The organic silver salt may be of any desired organic compound containing a source capable of reducing silver ion. Preferred are silver salts of organic acids, typically long chain aliphatic carboxylic acids having 10 to 30 carbon atoms, especially 15 to 28 carbon atoms. Also preferred are complexes of organic or inorganic silver salts with ligands having a stability constant in the range of 4.0 to 10.0. A silver-providing substance is preferably used in an amount of about 5 to 30% by weight of an image forming layer. Preferred organic silver salts include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver stearate, silver oleate, silver laurate, silver caproate, silver myristate, silver palmitate, silver maleate, silver fumarate, silver tartrate, silver linolate, silver butyrate, silver camphorate and mixtures thereof.

Silver salts of compounds having a mercapto or thion group and derivatives thereof are also useful. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido)-benzothiazole, silver salts of thioglycolic acids such as silver salts of S-alkylthioglycolic acids wherein the alkyl group has 12 to 22 carbon atoms, silver salts of dithiocarboxylic acids such as a silver salt of dithioacetic acid, silver salts of thioamides, a silver salt of 5-carboxyl-1-methyl-2-phenyl-4-thiopyridine, silver salts of mercapto-triazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thion compounds such as a silver salt of 3-(3-carboxyethyl)-4-methyl-4-thiazoline-2-thione as described in U.S. Pat. No. 3,301,768. Compounds containing an imino group may also be used. Preferred examples of these compounds include silver salts of benzotriazole and derivatives thereof, for example, silver salts of benzotriazoles such as silver methyl-benzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat No. 4,220,709. Also useful are various silver acetylide compounds as described, for example, in U.S. Pat. No. 4,761,361 and 4,775,613.

The organic silver salt which can be used herein may take any desired shape although needle crystals having a minor axis and a major axis are preferred. The inverse proportional relationship between the size of silver salt crystal grains and their covering power that is well known for photosensitive silver halide materials also applies to the photothermographic material of the present invention. That is, as organic silver salt grains constituting image forming regions of photothermographic material increase in size, the covering power becomes smaller and the image density becomes lower. It is thus necessary to reduce the grain size. In the practice of the invention, grains should preferably have a minor axis of 0.01 μm to 0.20 μm, more preferably 0.01 μm to 0.15 μm and a major axis of 0.10 μm to 5.0 μm, more preferably 0.10 μm to 4.0 μm. The grain size distribution is desirably monodisperse. The monodisperse distribution means that a standard deviation of the length of minor and major axes divided by the length, respectively, expressed in percent, is preferably up to 100%, more preferably up to 80%, most preferably up to 50%. It can be determined from the measurement of the shape of organic silver salt grains using an image obtained through a transmission electron microscope. Another method for determining a monodisperse distribution is to determine a standard deviation of a volume weighed mean diameter. The standard deviation divided by the volume weighed mean diameter, expressed in percent, which is a coefficient of variation, is preferably up to 100%, more preferably up to 80%, most preferably up to 50%. It may be determined by irradiating laser light, for example, to organic silver salt grains dispersed in liquid and determining the auto-correlation function of the fluctuation of scattering light relative to a time change, and obtaining the grain size (volume weighed mean diameter) therefrom.

With antifoggants, stabilizers and stabilizer precursors, the silver halide emulsion and/or organic silver salt according to the invention can be further protected against formation of additional fog and stabilized against lowering of sensitivity during shelf storage. Suitable antifoggants, stabilizers and stabilizer precursors which can be used alone or in combination include thiazonium salts as described in U.S. Pat Nos. 2,131,038 and 2,694,716, azaindenes as described in U.S. Pat Nos. 2,886,437 and 2,444,605, mercury salts as described in U.S. Pat Nos. 2,728,663, urazoles as described in U.S. Pat No. 3,287,135, sulfocatechols as described in U.S. Pat. No. 3,235,652, oximes, nitrons and nitroindazoles as described in UKP 623,448, polyvalent metal salts as described in U.S. Pat No. 2,839,405, thiuronium salts as described in U.S. Pat No. 3,220,839, palladium, platinum and gold salts as described in U.S. Pat Nos. 2,566,263 and 2,597,915, halogen-substituted organic compounds as described in U.S. Pat Nos. 4,108,665 and 4,442,202, triazines as described in U.S. Pat Nos. 4,128,557, 4,137,079, 4,138,365 and 4,459,350, and phosphorus compounds as described in U.S. Pat No. 4,411,985.

In the photosensitive emulsion layer, polyhydric alcohols (e.g., glycerin and diols as described in U.S. Pat No. 2,960,404), fatty acids and esters thereof as described in U.S. Pat Nos. 2,588,765 and 3,121,060, and silicone resins as described in UKP 955,061 may be added as a plasticizer and lubricant.

According to the invention, a hardener may be used in various layers including a photosensitive emulsion layer, protective layer, and back layer. Examples of the hardener include polyisocyanates as described in U.S. Pat No. 4,281,060 and JP-A 208193/1994, epoxy compounds as described in U.S. Pat No. 4,791,042, and vinyl sulfones as described in JP-A 89048/1987.

In the practice of the invention, a surfactant may be used for the purposes of improving coating and electric charging properties. The surfactant used herein may be nonionic, anionic or cationic or a fluorinated one. Examples include fluorinated polymer surfactants as described in JP-A 170950/1987 and U.S. Pat No. 5,382,504, fluorinated surfactants as described in JP-A 244945/1985 and 188135/1988, polysiloxane surfactants as described in U.S. Pat No. 3,885,965, and polyalkylene oxide and anionic surfactants as described in JP-A 301140/1994.

Sensitizing dve

A sensitizing dye is also useful in the practice of the invention. There may be used any of sensitizing dyes which can spectrally sensitize silver halide grains in a desired wavelength region when adsorbed to the silver halide grains. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes which can be used herein are described in Research Disclosure, Item 17643 IV-A (December 1978, page 23), ibid., Item 1831 X (August 1979, page 437) and the references cited therein.

It is advantageous to select a sensitizing dye having appropriate spectral sensitivity to the spectral properties of a particular light source of various laser imagers, scanners, image setters and printing plate-forming cameras. Exemplary dyes for spectral sensitization to red light include compounds I-1 to I-38 described in JP-A 18726/1979, compounds I-1 to I-35 described in JP-A 75322/1994, and compounds I-1 to I-34 described in JP-A 287338/1995 for He—Ne laser light sources and dyes 1 to 20 described in JP-B 39818/1980, compounds I-1 to I-37 described in JP-A 284343/1987, and compounds I-1 to I-34 described in JP-A 287338/1995 for LED light sources.

More specifically, photosensitive silver halide can be spectrally advantageously sensitized with various known dyes including cyanine, merocyanine, styryl, hemicyanine, oxonol, hemioxonol and xanthene dyes. Useful cyanine dyes are cyanine dyes having a basic nucleus such as a thiazoline, oxazoline, pyrroline, pyridine, oxazole, thiazole, selenazole and imidazole nucleus. Preferred examples of the useful merocyanine dye contain an acidic nucleus such as a thiohydantoin, rhodanine, oxazolidinedione, thiazolinedione, barbituric acid, thiazolinone, malononitrile, and pyrazolone nucleus in addition to the above-mentioned basic nucleus. Among the above-mentioned cyanine and merocyanine dyes, those having an imino or carboxyl group are especially effective. A suitable choice may be made of well-known dyes as described, for example, in U.S. Pat Nos. 3,761,279, 3,719,495, and 3,877,943, UKP 1,466,201, 1,469,117, and 1,422,057, JP-B 10391/1991 and 52387/1994, JP-A 341432/1993, 194781/1994, and 301141/1994. Especially preferred dye structures are cyanine dyes having a thioether bond, examples of which are the cyanine dyes described in JP-A 58239/1987, 138638/1991, 138642/1991, 255840/1992, 72659/1993, 72661/1993, 222491/1994, 230506/1990, 258757/1994, 317868/1994, and 324425/1994, and Publication of International Patent Application No. 500926/1995.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization. Useful sensitizing dyes, combinations of dyes showing supersensitization, and compounds showing supersensitization are described in Research Disclosure, Vol. 176, 17643 (December 1978), page 23, IV J and JP-B 25500/1974 and 4933/1968, JP-A 19032/1984 and 192242/1984.

The sensitizing dyes may be used in admixture of two or more in the practice of the invention. The sensitizing dye is added to a silver halide emulsion by directly dispersing the dye in the emulsion or by dissolving the dye in a solvent and adding the solution to the emulsion. The solvent used herein includes water, methanol, ethanol, propanol, acetone, methyl cellosolve, 2,2,3,3-tetrafluoro-propanol, 2,2,2-trifluoroethanol, 3-methoxy-l-propanol, 3-methoxy-1-butanol, 1-methoxy-2-propanol, N,N-dimethyl-formamide and mixtures thereof.

Also useful are a method of dissolving a dye in a volatile organic solvent, dispersing the solution in water or hydrophilic colloid and adding the dispersion to an emulsion as disclosed in U.S. Pat No. 3,469,987, a method of dissolving a dye in an acid and adding the solution to an emulsion or forming an aqueous solution of a dye with the aid of an acid or base and adding it to an emulsion as disclosed in JP-B 23389/1969, 27555/1969 and 22091/1982, a method of forming an aqueous solution or colloidal dispersion of a dye with the aid of a surfactant and adding it to an emulsion as disclosed in U.S. Pat Nos. 3,822,135 and 4,006,025, a method of directly dispersing a dye in hydrophilic colloid and adding the dispersion to an emulsion as disclosed in JP-A 102733/1978 and 105141/1983, and a method of dissolving a dye using a compound capable of red shift and adding the solution to an emulsion as disclosed in JP-A 74624/1976. It is also acceptable to apply ultrasonic waves to a solution.

The time when the sensitizing dye is added to the silver halide emulsion according to the invention is at any step of an emulsion preparing process which has been acknowledged effective. The sensitizing dye may be added to the emulsion at any stage or step before the emulsion is coated, for example, at a stage prior to the silver halide grain forming step and/or desalting step, during the desalting step and/or a stage from desalting to the start of chemical ripening as disclosed in U.S. Pat Nos. 2,735,766, 3,628,960, 4,183,756, and 4,225,666, JP-A 184142/1983 and 196749/1985, and a stage immediately before or during chemical ripening and a stage from chemical ripening to emulsion coating as disclosed in JP-A 113920/1983. Also as disclosed in USP 4,225,666 and JP-A 7629/1983, an identical compound may be added alone or in combination with a compound of different structure in divided portions, for example, in divided portions during a grain forming step and during a chemical ripening step or after the completion of chemical ripening, or before or during chemical ripening and after the completion thereof. The type of compound or the combination of compounds to be added in divided portions may be changed.

Reducing Agaent

The reducing agent for the organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 1 to 10% by weight of an image forming layer. In a multilayer embodiment wherein the reducing agent is added to a layer other than an emulsion layer, the reducing agent should preferably be contained in a slightly higher amount of about 2 to 15% by weight of that layer.

For photothermographic materials using organic silver salts, a wide range of reducing agents are disclosed. Exemplary reducing agents include amidoximes such as phenylamidoxime, 2-thienylamidoxime, and p-phenoxyphenyl-amidoxime; azines such as 4-hydroxy-3,5-dimethoxy-benzaldehydeazine; combinations of aliphatic carboxylic acid arylhydrazides with ascorbic acid such as a combination of 2,2'-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxyl-amine, piperidinohexosereductone or formyl-4-methylphenyl-hydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2'-dihydroxy-1-1-1'-binaphthyl, 6,6'-dibromo-2,2'-dihydroxy-1,1'-binaphthyl, and bis(2-hydroxy-1-naphthyl) methane; combinations of bis-β-naphthols with 1,3-dihydroxybenzene derivatives such as 2,4-dihydroxybenzophenone and 2',4'-dihydroxyacetophenone; 5-pyrazolones such as 3-methyl-1-phenyl-5-pyrazolone; reductones such as dimethylaminohexose-reductone, anhydrodihydroaminohexosereductone and anhydrodihydropiperidonehexosereductone; sulfonamidephenol reducing agents such as 2,6-dichloro-4-benzenesulfonamide-phenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl) propane, 4,4-ethylidene-bis(2-t-butyl-6-methylphenol), 1,1-bis(2-hydroxy-3,5-dimethyl-phenyl)-3,5,5-trimethylhexane, and 2,2-bis(3,5-dimethyl-4-hydroxyphenyl)propane; ascorbic acid derivatives such as 1-ascorbyl palmitate and ascorbyl stearate; aldehydes and ketones such as benzil and diacetyl; 3-pyrazolidones and certain indane-1,3-diones.

It is sometimes advantageous to add a mercury (II) salt to an emulsion layer as an antifoggant though not necessary in the practice of the invention. Mercury (II) salts preferred to this end are mercury acetate and mercury bromide.

In the photothermographic material of the invention, mercapto, disulfide and thion compounds may be added for the purposes of retarding or accelerating development to control development, improving spectral sensitization efficiency, and improving storage stability before and after development.

Where mercapto compounds are used herein, any structure is acceptable. Preferred are structures represented by Ar-SM and Ar-S-S-Ar wherein M is a hydrogen atom or alkali metal atom, and Ar is an aromatic ring or fused aromatic ring having at least one nitrogen, sulfur, oxygen, selenium or tellurium atom. Preferred hetero-aromatic rings are benzimidazole, naphthimidazole, benzothiazole, naphtho-thiazole, benzoxazole, naphthoxazole, benzoselenazole, benzotellurazole, imidazole, oxazole, pyrrazole, triazole, thiadiazole, tetrazole, triazine, pyrimidine, pyridazine, pyrazine, pyridine, purine, quinoline and quinazolinone rings. These hetero-aromatic rings may have a substituent selected from the group consisting of halogen (e.g., Br and Cl), hydroxy, amino, carboxy, alkyl groups (having at least 1 carbon atom, preferably 1 to 4 carbon atoms), and alkoxy groups (having at least 1 carbon atom, preferably 1 to 4 carbon atoms). Illustrative, non-limiting examples of the mercapto-substituted hetero-aromatic compound include 2-mercaptobenzimidazole, 2-mercaptobenzoxazole, 2-mercapto-benzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercapto-pyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydro-chloride, 3-mercapto-5-phenyl-1,2,4-triazole, and 2-mercapto-4-phenyloxazole.

These mercapto compounds are preferably added to the emulsion layer in amounts of 0.001 to 1.0 mol, more preferably 0.01 to 0.3 mol per mol of silver.

Hydrazine derivatives may be used in the present invention. Typical hydrazine derivatives used herein are compounds of the general formula (I) described in Japanese Patent Application No. 47961/1994, specifically compounds I-1 to I-53 described therein.

Other hydrazine derivatives are also preferred. Exemplary hydrazine derivatives include the compounds of the chemical formula [1] in JP-B 77138/1994, more specifically the compounds described on pages 3 and 4 of the same; the compounds of the general formula (1) in JP-B 93082/1994, more specifically compound Nos. 1 to 38 described on pages 8 to 18 of the same; the compounds of the general formulae (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39 and 40 of the same; and the compounds of the general formulae (1) and (2) in JP-A 289520/1994, more specifically compounds 1-1 to 1-17 and 2-1 described on pages 5 to 7 of the same; the compounds of the chemical formulae [2] and [3] in JP-A 313936/1994, more specifically the compounds described on pages 6 to 19 of the same; the compounds of the chemical formula [1] in JP-A 313951/1994, more specifically the compounds described on pages 3 to 5 of the same; the compounds of the general formula (1) in JP-A 5610/1995, more specifically compounds I-1 to I-38 described on pages 5 to 10 of the same; the compounds of the general formula (II) in JP-A 77783/1995, more specifically compounds II-1 to II-102 described on pages 10 to 27 of the same; the compounds of the general formulae (H) and (Ha) in JP-A 104426/1995, more specifically compounds H-1 to H-44 described on pages 8 to 15 of the same; the compounds having an anionic group in proximity to a hydrazine group or a nonionic group forming an intramolecular hydrogen bond with the hydrogen atom of hydrazine described in Japanese Patent Application No. 191007/1995, specifically the compounds of the general formulae (A), (B), (C), (D), (E), and (F), more specifically compounds N-1 to N-30 described therein; and the compounds of the general formula (1) in Japanese Patent Application No. 191007/1995, more specifically compounds D-1 to D-55 described therein.

Hydrazine nucleating agents are used by dissolving in suitable water-miscible organic solvents such as alcohols (e.g., methanol, ethanol, propanol, and fluorinated alcohols), ketones (e.g., aetone and methyl ethyl ketone), dimethylformamide, dimethylsulfoxide, and methyl cellosolve.

A well-known emulsifying dispersion method is used for dissolving the hydrazine derivative with the aid of an oil such as dibutyl phthalate, tricresyl phosphate, glyceryl triacetate and diethyl phthalate or an auxiliary solvent such as ethyl acetate and cyclohexanone whereby an emulsified dispersion is mechanically prepared. Alternatively, a method known as a solid dispersion method is used for dispersing the hydrazine derivative in powder form in water in a ball mill, colloidal mill or ultrasonic mixer.

The hydrazine nucleating agent may be added to a silver halide emulsion layer on a support or any hydrophilic colloid layer on the same side, preferably to the silver halide emulsion layer or a hydrophilic colloid layer disposed adjacent thereto.

An appropriate amount of hydrazine nucleating agent is 1 $\mu$mol to 10 mmol, more preferably 10 $\mu$mol to 5 mmol, most preferably 20 $\mu$mol to 5 mmol per mol of silver halide.

According to the invention, the photothermographic emulsion may be coated on a variety of supports. Typical supports include polyester film, subbed polyester film, poly (ethylene terephthalate) film, polyethylene naphthalate film, cellulose nitrate film, cellulose ester film, poly(vinyl acetal) film, polycarbonate film and related or resinous materials, as well as glass and the like. The supports are preferably transparent.

The photosensitive material of the invention may have an antistatic or electroconductive layer, for example, a layer containing soluble salts (e.g., chlorides and nitrates), an evaporated metal layer, or a layer containing ionic polymers as described in U.S Pat. No. 2,861,056 and 3,206,312 or insoluble inorganic salts as described in U.S. Pat. No. 3,428,451.

A method for producing color images using the photothermographic material of the invention is as described in JP-A 13295/1995, page 10, left column, line 43 to page 11, left column, line 40. Stabilizers for color dye images are exemplified in UKP 1,326,889, U.S. Pat. Nos. 3,432,300, 3,698,909, 3,574,627, 3,573,050, 3,764,337, and 4,042,394.

In the practice of the invention, the photothermographic emulsion can be coated by various coating procedures including dip coating, air knife coating, flow coating, and extrusion coating using a hopper of the type described in U.S. Pat. No. 2,681,294. If desired, two or more layers may be concurrently coated by the methods described in U.S. Pat. No. 2,761,791 and UKP 837,095.

In the photothermographic material of the invention, there may be contained additional layers, for example, a dye accepting layer for accepting a mobile dye image, an opacifying layer when reflection printing is desired, a protective topcoat layer, and a primer layer well known in the photothermographic art. The photosensitive material of the invention is preferably such that only a single sheet of the photosensitive material can form an image. That is, it is preferred that a functional layer necessary to form an image such as an image receiving layer does not constitute a separate member.

A surface protective layer may be provided in the photosensitive material according to the present invention for the purpose of preventing adhesion of an image forming layer. The surface protective layer may be formed of any adhesion-preventing material. Examples of the adhesion-preventing material include wax, silica particles, styrene-containing elastomeric block copolymers (e.g., styrene-butadiene-styrene and styrene-isoprene-styrene), cellulose acetate, cellulose acetate butyrate, cellulose propionate and mixtures thereof.

In the emulsion layer or a protective layer therefor according to the invention, there may be used matte agents, for example, starch, titanium dioxide, zinc oxide, and silica as well as polymer beads including beads of the type described in U.S. Pat. Nos. 2,992,101 and 2,701,245. The emulsion surface may have any degree of matte insofar as no star dust failures occur although a Bekk smoothness of 500 to 10,000 seconds, especially 1,000 to 10,000 seconds is preferred.

The emulsion layer is based on a binder. Exemplary binders are naturally occurring polymers and synthetic resins, for example, gelatin, polyvinyl acetal, polyvinyl chloride, polyvinyl acetate, cellulose acetate, polyolefins, polyesters, polystyrene, polyacrylonitrile, and polycarbonate. Of course, copolymers and terpolymers are included. Preferred polymers are polyvinyl butyral, butyl-ethyl cellulose, methacrylate copolymers, maleic anhydride ester copolymers, polystyrene and butadiene-styrene copolymers. These polymers may be used alone or in admixture of two or more as desired. The polymer is used in such a range that it may effectively function as a binder to carry various components. The effective range may be properly determined by those skilled in the art without undue experimentation. Taken at least as a measure for carrying the organic silver salt in the film, the weight ratio of the binder to the organic silver salt is preferably in the range of from 15:1 to 1:2, more preferably from 8:1 to 1:1.

It is sometimes advantageous to use an additive known as a "toner" for improving images in addition to the above-mentioned components. The toner is used in an amount of 0.1 to 10% by weight of the entire silver-carrying components. The toners are compounds well known in the photographic art as shown in U.S. Pat. Nos. 3,080,254, 3,847,612 and 4,123,282.

Examples of the toner include phthalimide and N-hydroxyphthalimide; cyclic imides such as succinimide, pyrazoline-5-ones, quinazoline, 3-phenyl-2-pyrazolin-5-one, 1-phenylurazol, quinazoline and 2,4-thiazolizinedione; naphthalimides such as N-hydroxy-1,8-naphthalimide; cobalt complexes such as cobaltic hexamine trifluoroacetate; mercaptans as exemplified by 3-mercapto-1,2,4-triazole, 2,4-dimercaptopyrimidine, 3-mercapto-4,5-diphenyl-1,2,4-triazole, and 2,5-dimercapto-1,3,4-thiadiazole; N-(aminomethyl)aryldicarboxyimides such as (N,N-dimethylaminomethyl)phthalimide and N,N-(dimethylaminomethyl)-naphthalene-2,3-dicarboxyimide; blocked pyrazoles, isothiuronium derivatives and certain photo-bleach agents such as N,N'-hexamethylenebis(l-carbamoyl-3,5-dimethylpyrazole), 1,8-(3,6-diazaoctane)bis(isothiuroniumtrifluoroacetate) and 2-tribromomethylsulfonyl-benzothiazole; 3-ethyl-5-{(3-ethyl-2-benzothiazolinylidene)-1-methylethylidene}-2-thio-2,4-oxazolidinedione; phthalazinone, phthalazinone derivatives or metal salts, or derivatives such as 4-(l-naphthyl)phthalazinone, 6-chlorophthalazinone, 5,7-dimethoxyphthalazinone and 2,3-dihydro-1,4-phthalazinedione; combinations of phthalazinone with phthalic acid derivatives (e.g., phthalic acid, 4-methylphthalic acid, 4-nitrophthalic acid, and tetrachlorophthalic anhydride); phthalazine, phthalazine derivatives or metal salts, or derivatives such as 4-(1-naphthyl)phthlazine, 6-chlorophthalazine, 5,7-dimethoxyphthalazine and 2,3-dihydrophthlazine; combinations of phthalazine with phthalic acid derivatives (e.g., phthalic acid, 4-methylphthalic acid, 4-nitrophthalic acid, and tetrachlorophthalic anhydride); quinazolinedione, benzoxazine or naphthoxazine derivatives; rhodium complexes which function not only as a tone regulating agent, but also as a source of halide ion for generating silver halide in situ, for example, ammonium hexachlororhodinate (III), rhodium bromide, rhodium nitrate and potassium hexachlororhodinate (III); inorganic peroxides and persulfates such as ammonium peroxide disulfide and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidine and asym-triazines such as 2,4-dihydroxypyrimidine and 2-hydroxy-4-aminopyrimidine; azauracil and tetraazapentalene derivatives such as 3,6-dimercapto-1,4-diphenyl-lH, 4H-2,3a,5,6a-tetraazapentalene, and 1,4-di(o-chlorophenyl)-3,6-dimercapto-1H,4H-2,3a,5,6a-tetraazapentalene.

The photothermographic material of the present invention is preferably a one side photosensitive material having at least one photosensitive layer containing a silver halide emulsion on one surface of a support and a back layer on the other surface.

In the present invention, a matte agent may be added to the one side photosensitive material for improving transportation. The matte agent used herein is generally a microparticulate water-insoluble organic or inorganic compound. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include polymethyl acrylate, polymethyl methacrylate, polyacrylonitrile, acrylonitrile-$\alpha$-mehtylastyrene copolymers, polystyrene, styrene-divinylbenzene copolymers, polyvinyl acetate, polyethylene carbonate, and polytetrafluoroethylene; exemplary cellulose derivatives include methyl cellulose, cellulose acetate, and cellulose acetate propionate; exemplary starch derivatives include carboxystarch, carboxynitrophenyl starch, urea-formaldehyde-starch reaction products, gelatin hardened with well-known curing agents, and hardened gelatin which has been coaceruvation hardened into microcapsulated hollow particles. Preferred examples of the inorganic compound which can be used as the matte agent include silicon dioxide, titanium dioxide, magnesium dioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary. The size and shape of the matte agent are not critical. The matte agent of any particle size may be used although matte agents having a particle size of 0.1 $\mu$m to 30 $\mu$m are preferably used in the practice of the invention. The particle size distribution of the matte agent may be either narrow or wide. Nevertheless, since the haze and surface luster of photosensitive material are largely affected by the matte agent, it is preferred to adjust the particle size, shape and particle size distribution of a matte agent as desired during preparation of the matte agent or by mixing plural matte agents.

In the practice of the invention, the back layer should preferably have a degree of matte as expressed by a Bekk smoothness of 10 to 250 seconds, more preferably 50 to 180 seconds.

In the photosensitive material of the invention, the matte agent is preferably contained in an outermost surface layer, a layer functioning as an outermost surface layer, a layer close to the outer surface or a layer functioning as a so-called protective layer.

In the practice of the invention, the binder used in the back layer is preferably transparent or semi-transparent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methy methacrylate), polyvinyl chloride, poly(meth-acrylic acid), copoly(styrene-maleic anhydride), copoly-(styrene-acrylonitrile), copoly (styrene-butadiene), poly-vinyl acetals (e.g., polyvinyl formal and polyvinyl butyral), polyesters, polyurethanes, phenoxy resins, poly(vinylidene chloride), polyepoxides, polycarbonates, poly(vinyl acetate), cellulose esters, and polyamides. The binder may be dispersed in water to form a dispersion which is coated to form a layer.

A backside resistive heating layer as described in U.S. Pat. Nos. 4,460,681 and 4,374,921 may be used in a photothermographic imaging system according to the present invention.

EXAMPLE

Examples of the present invention are given below by way of illustration and not by way of limitation.

The trade names used in Examples have the following meaning.

Byron 200: polyester by Toyobo K. K.

CAB 171-15S and 381-20: cellulose acetate butyrate by Eastman Chemical Products, Inc.

Denka Butyral: polyvinyl butyral by Denki Kagaku Kogyo K.K.

Megafax F-176P: fluorinated surfactant by Dai-Nihon Ink Chemical Industry K. K.

Sildex: spherical silica by Dokai Chemical K. K. Sumidur N3500: polyisocyanate by Sumitomo-Bayern Urethane K. K.

Example 1

Preparation of Silver Halide Grains

In 700 ml of water were dissolved 22 grams of phthalated gelatin and 30 mg of potassium bromide. The solution was adjusted to pH 5.0 at a temperature of 35° C. To the solution, 159 ml of an aqueous solution containing 18.6 grams of silver nitrate and an aqueous solution containing potassium bromide and potassium iodide in a molar ratio of 92:8 were added over 10 minutes by a controlled double jet method while maintaining the solution at pAg 7.7. Then, 476 ml of an aqueous solution containing 55.4 grams of silver nitrate and an aqueous solution containing 12 μmol/liter of dipotassium hexachloroiridate and 1 mol/liter of potassium bromide were added over 30 minutes by a controlled double jet method while maintaining the solution at pAg 7.7. The pH of the solution was lowered to cause flocculation and sedimentation for desalting. The solution was adjusted to pH 5.9 and pAg 8.2 by adding 0.1 gram of phenoxyethanol. There were obtained silver iodobromide grains in the form of cubic grains having an iodine content of 8 mol% in the core and 2 mol% on the average, a mean grain size of 0.05 μm, a coefficient of variation of projected area of 8%, and a (100) plane proportion of 88%.

The thus obtained silver halide grains were heated at 60° C., to which 85 μmol of sodium thiosulfate, 11 μmol of 2,3,4,5,6-pentafluorophenyldiphenylphosphine selenide, 15 μmol of tellurium compound 1, 3.5 μmol of chloroauric acid, and 275 μmol of thiocyanic acid were added per mol of silver. The solution was ripened for 120 minutes and quenched to 30° C, obtaining a silver halide emulsion.

Preparation of Organic Acid Silver Emulsion

A mixture of 1.3 grams of stearic acid, 0.5 gram of arachidonic acid, 8.5 grams of behenic acid, and 300 ml of distilled water was stirred at 90° C. for 15 minutes. With vigorous stirring, 31.1 ml of 1N NaOH aqueous solution was added over 15 minutes to the solution, which was cooled to 30° C. 7 ml of 1N phosphoric acid aqueous solution was added to the solution. With more vigorous stirring, 0.01 gram of N-bromosuccinimide was added to the solution and the above-prepared silver halide emulsion was added in such an amount as to give 1.25 mmol of silver halide. Further, 25 ml of iN silver nitrate aqueous solution was added over 2 minutes and stirring was continued for 90 minutes. The solids were separated by suction filtration and washed with water until the water filtrate reached a conductivity of 30 μS/cm. To the thus obtained solids was added 50 grams of a 1.2 wt % butyl acetate solution of polyvinyl acetate, followed by agitation. Agitation was stopped and the reaction mixture was allowed to stand whereupon it separated into an oil layer and an aqueous layer. The aqueous layer was removed together with salts contained therein. To the oil layer was added 20 grams of a 2.5 wt % 2-butanone solution of polyvinyl butyral (Denka Butyral #3000-K), followed by agitation. Then 0.1 mmol of pyridinium bromide perbromide and 0.16 mmol of calcium bromide dihydrate were added thereto together with 0.9 gram of methanol, and 40 grams of 2-butanone and 7.8 grams of polyvinyl butyral (PVB B-76 by Monsanto Co.) were further added. The mixture was dispersed by means of a homogenizer, obtaining an organic acid silver salt emulsion of needle grains having a mean minor diameter of 0.04 μm, mean major diameter of 1 μm and a coefficient of variation U.S. Pat. No. of 30%.

Preparation of Emulsion Layer Coating Solution

Various chemicals were added to the above-prepared organic acid silver salt emulsion in amounts per mol of silver. With stirring at 250° C., 10 mg of sodium phenylthiosulfonate, 65 mg of coloring matter 1, 2 grams of 2-mercapto-5-methylbenzimidazole, 21.5 grams of 4-chloro-benzophenone-2-carboxylic acid, 580 grams of 2-butanone, and 220 grams of dimethylformamide were added to the emulsion, which was allowed to stand for 3 hours. With stirring, there were further added 8 grams of 5-tribromomethyl-sulfonyl-2-methylthiadiazole, 6 grams of 2-tribromomethyl-sulfonylbenzothiazole, 5 grams of 4,6-ditrichloromethyl-2-phenyltriazine, 2 grams of disulfide compound 1, 200 grams of 1,1-bis(2-hydroxy-3,5-dimethylphenyl)-3,5,5-trimethyl-hexane, 5 grams of tetrachlorophthalic acid, 1.1 grams of Megafax F-176P, 590 grams of 2-butanone and 10 grams of methyl isobutyl ketone. Additionally, a dye compound as shown in Table 1 was added in such an amount as to give an absorbance as shown in Table 1. Further, 31 grams of Byron 200 was added.

Emulsion Surface Protective Laver Coating Solution

A coating solution was prepared by dissolving 75 grams of CAB 171-15S, 5.7 grams of 4-methylphthalic acid, 1.5 grams of tetrachlorophthalic anhydride, 11 grams of phthalazine, 0.3 grams of Megafax F-176P, 2 grams of Sildex H31 (spherical silica having a mean particle size of 3 μm), and 6 grams of Sumidur N3500 in 3,070 grams of 2-butanone and 30 grams of ethyl acetate.

Back Laver Coating Solution

Calcium compound 1 was synthesized by adding 167 ml of an aqueous solution containing 0.019 mol of calcium chloride and 125 ml of 25% aqueous ammonia to 1 liter of an ethanol solution containing 0.08 mol of 3,5-di-tert-butylcatechol, and blowing air into the solution for 3 hours at room temperature. There were precipitated crystals of bis[2-(3,5-di-tert-butyl-o-benzoquinonemonoimine)-4,6-di-tert-butylphenolato]calcium (II).

A back layer coating solution was prepared by adding 12 grams of polyvinyl butyral (Denka Butyral #4000-2), 12 grams of CAB 381-30, a dye compound as shown in Table 1 in an amount to provide an absorbance as shown in Table 1, 75 mg of calcium compound 1, 100 mg of dyestuff 1, 5 mg of dyestuff 2, 0.4 gram of Sildex H121 (spherical silica having a mean particle size 12 μm), 0.4 gram of Sildex H51 (spherical silica having a mean particle size 5 μm), 0.1 gram of Megafax F-176P, and 2 grams of Sumidur N3500 to 500 grams of 2-butanone and 500 grams of 2-propanol and stirring the mixture for dissolving the components.

Preparation of Coated Sample

The emulsion layer coating solution prepared above was coated to one surface of a 175-μm thick polyethylene terephthalate support tinted with a blue dye so as to provide a coverage of 2.3 g/m$^2$ of silver. The back layer coating solution was then coated on the opposite surface of the support to a dry thickness of 3 μm. Further, the emulsion surface protective layer coating solution was coated onto the emulsion layer to a dry thickness of 2 μm. The thus obtained photosensitive material has a surface smoothness expressed by a Bekk smoothness of 1,000 seconds on the emulsion surface and 70 seconds on the back surface as measured by the Oken type smoothness measurement described in J. TAPPI, Paper Pulp Test No. 5.

The tellurium compound 1, disulfide compound 1, coloring matter 1, dyestuffs 1 and 2 have the structures shown below.

tellurium compound 1

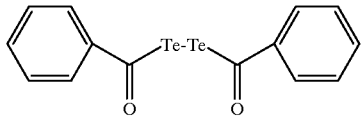

disulfide compound 1

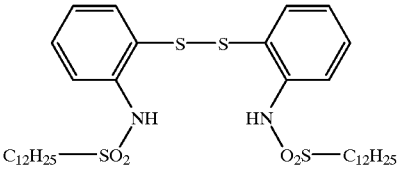

coloring matter 1

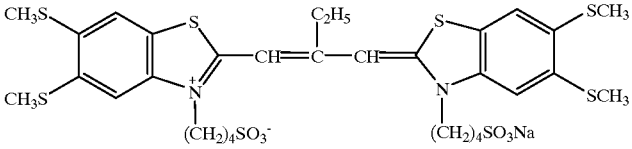

dyestuff 1

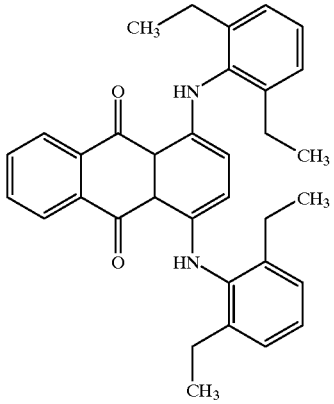

dyestuff 2

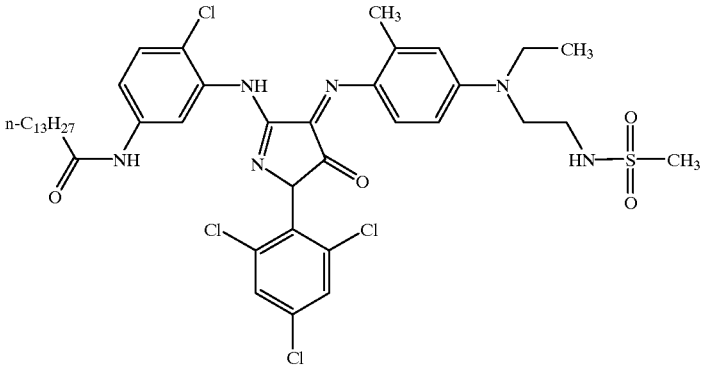

The support, photosensitive emulsion layer, back layer, and protective layer had a refractive index of 1.665, 1.654, 1.663, and 1.672, respectively, as measured by an Abbe's refractometer using a sodium lamp.

Measurement of Absorbance

The photosensitive material with its back layer removed was placed at the cell mount position of a spectrophotometer U-3410 (Hitachi K. K.) such that the photosensitive emulsion layer faced the light source and was extended perpendicular to the incident light. The absorbance (A) at an exposure wavelength of 635 nm was measured and the absorbance of the support as a reference was subtracted from the measurement result. The light transmitted by the photosensitive material was captured by an integrating sphere (window area 20 mm×15 mm) located about 12 cm apart therefrom and then collected by a photomultiplier. The absorbance of the back layer was similarly measured.

Observation of Interference Fringes

Using an exposure apparatus equipped with a semiconductor laser of 635 nm wavelength as a light source and operating the laser, the photosensitive material on its emulsion surface was uniformly exposed to form throughout the photosensitive material a uniform image having an optical density of about 1.0 with fog subtracted. During image formation, the angle between the surface of the photosensitive material and the laser light beam was 80°. The image was observed whether or not interference fringes occurred. Interference fringe rating was made on a five-point scale according to the following criterion.

| Point | Interference fringes found |
|---|---|
| 5 | no interference fringes |
| 4 | intermediate between points 5 and 3 |
| 3 | interference fringes are perceivable, but very weak and practically acceptable |
| 2 | intermediate between points 3 and 1 |
| 1 | interference fringes are perceivable and practically unacceptable |

It is noted that after exposure, each photosensitive material was developed by heating on a heat drum at 120° C. for 20 seconds and then illuminated with light from a xenon lamp for 20 minutes.

The results of absorbance measurement and interference fringe rating are shown in Table 1.

TABLE 1

| Sample | Emulsion layer | | Back layer | | Interference fringe |
|---|---|---|---|---|---|
| No. | Dye | A | Dye | A | rating |
| 1* | — | 0.14 | Compound 34 | 0.2 | 1 |
| 2 | Compound 7 | 0.35 | Compound 34 | 0.2 | 4 |
| 3 | Compound 7 | 0.58 | Compound 34 | 0.2 | 4 |
| 4 | Compound 45 | 0.35 | Compound 34 | 0.2 | 4 |
| 5 | Compound 45 | 0.58 | Compound 34 | 0.2 | 4 |
| 6 | Compound 34 | 0.35 | Compound 34 | 0.2 | 4 |
| 7 | Compound 34 | 0.58 | Compound 34 | 0.2 | 4 |
| 8* | — | 0.14 | Compound 34 | 0.41 | 2 |
| 9* | — | 0.14 | Compound 34 | 0.64 | 2 |

* comparison

It is evident from Table 1 that photosensitive materials within the scope of the invention are effective for suppressing interference fringes.

Example 2

Preparation of Organic Acid Silver Aalt Emulsion

To 12 liters of water were added 840 grams of behenic acid and 95 grams of stearic acid. To the solution kept at 90° C., a solution of 48 grams of sodium hydroxide and 63 grams of sodium carbonate in 1.5 liters of water was added. The solution was stirred for 40 minutes and then cooled to 50° C. whereupon 1.0 liter of a 1% aqueous solution of N-bromosuccinimide was added. With stirring, 2.3 liters of a 17% aqueous solution of silver nitrate was slowly added. While the solution was kept at 35° C., with stirring, 1.5 liters of a 2% aqueous solution of potassium bromide was added over 2 minutes. The solution was stirred for 30 minutes whereupon 2.5 liters of a 1% aqueous solution of N-bromosuccinimide was added. With stirring, 3,300 grams of a 1.2 wt % butyl acetate solution of polyvinyl acetate was added to the aqueous mixture. The mixture was allowed to stand for 10 minutes, separating into two layers. After the aqueous layer was removed, the remaining gel was washed twice with water. There was obtained a gel-like mixture of silver behenate, silver stearate, and silver bromide, which was dispersed in 1,800 grams of a 2.6% isopropyl alcohol solution of polyvinyl butyral (Denka Butyral #3000-K). The dispersion was further dispersed in 600 grams of polyvinyl butyral (Denka Butyral #4000-2) and 300 grams of isopropyl alcohol, obtaining an organic acid silver salt emulsion of needle grains having a mean minor diameter of 0.05 μm, a mean major diameter of 1.2 μm, and a coefficient of variation of 25%. The silver bromide grains resulting from the addition of potassium bromide had a mean grain size of 0.06 μm.

Preparation of Emulsion Layer Coating Solution

Various chemicals were added to the above-prepared organic acid silver salt emulsion in amounts per mol of silver. With stirring at 25° C., 10 mg of sodium phenylthiosulfonate, 50 mg of coloring matter 1 (used in Example 1), 2 grams of 2-mercapto-5-methylbenzimidazole, 21.5 grams of 4-chlorobenzophenone-2-carboxylic acid, 580 grams of 2-butanone, and 220 grams of dimethylformamide were added to the emulsion, which was allowed to stand for 3 hours. With stirring, there were further added 8 grams of 5-tribromo-methylsulfonyl-2-methylthiadiazole, 6 grams of 2-tribromo-methylsulfonylbenzothiazole, 5 grams of 4,6-ditrichloro-methyl-2-phenyltriazine, 2 grams of disulfide compound 1 (used in Example 1), 205 grams of 1,1-bis(2-hydroxy-3,5-dimethylphenyl)-3,5,5-trimethylhexane, 5 grams of tetrachlorophthalic acid, 2.2 grams of a hydrazine derivative A, 1.1 grams of Megafax F-176P, 590 grams of 2-butanone and 10 grams of methyl isobutyl ketone. Additionally, a dye compound as shown in Table 2 was added in such an amount as to give an absorbance as shown in Table 2. Further, 28 grams of Byron 200 was added.

hydrazine derivative A

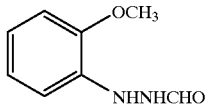

Emulsion Surface Protective Laver Coating Solution

A coating solution was prepared by dissolving 75 grams of CAB 171-15S, 5.7 grams of 4-methylphthalic acid, 1.5 grams of tetrachlorophthalic anhydride, 12 grams of phthalazine, 0.3 grams of Megafax F-176P, 2 grams of Sildex H31 (spherical silica having a mean particle size of 3 μm), and 10 grams of Sumidur N3500 in 3,070 grams of 2-butanone and 30 grams of ethyl acetate.

Back Laver Coating Solution

Calcium compound 1 was synthesized as in Example 1.

A back layer coating solution was prepared by adding 12 grams of polyvinyl butyral (Denka Butyral #4000-2), 12 grams of CAB 381-30, a dye compound as shown in Table 2 in an amount to provide an absorbance as shown in Table 2, 70 mg of calcium compound 1, 120 mg of dyestuff 1 (used in Example 1), 5 mg of dyestuff 2 (used in Example 1), 0.4 gram of Sildex H121 (spherical silica having a mean particle size 12 μm), 0.4 gram of Sildex H51 (spherical silica having a mean particle size 5 μm), 0.1 gram of Megafax F-176P, and 2 grams of Sumidur N3500 to 500 grams of 2-butanone and 500 grams of 2-propanol and stirring the mixture for dissolving the components.

Preparation of Coated Sample

The emulsion layer coating solution prepared above was coated to one surface of a 100-μm thick polyethylene terephthalate support untinted with a blue dye so as to provide a coverage of 1.1 g/m$^2$ of silver. The back layer coating solution was then coated on the opposite surface of the support to a dry thickness of 3 μm. Further, the emulsion surface protective layer coating solution was coated onto the emulsion layer to a dry thickness of 2 μm. The thus obtained photosensitive material has a surface smoothness expressed by a Bekk smoothness of 1,000 seconds on the emulsion surface and 70 seconds on the back surface as measured by the Oken type smoothness measurement described in J. TAPPI, Paper Pulp Test No. 5.

The support, photosensitive emulsion layer, back layer, and protective layer had a refractive index of 1.665, 1.654, 1.663, and 1.672, respectively, as measured by an Abbe's refractometer using a sodium lamp.

Measurement of Absorbance

The photosensitive material was measured for absorbance (A) as in Example 1.

Observation of Interference Fringes

Using an exposure apparatus equipped with a semiconductor laser of 635 nm wavelength as a light source and operating the laser, the photosensitive material on its emulsion surface was uniformly exposed to form throughout the photosensitive material a uniform image having an optical density of about 1.0 with fog subtracted. The exposure laser light was emitted in the longitudinal multiple mode by a high frequency superposition technique.

It is noted that after exposure, each photosensitive material was developed by heating on a heat drum at 110° C. for 20 seconds and then illuminated with light from a fluorescent lamp for 60 minutes.

The results of absorbance measurement and interference fringe rating are shown in Table 2.

TABLE 2

| Sample | Emulsion layer | | Back layer | | Interference fringe |
|---|---|---|---|---|---|
| No. | Dye | A | Dye | A | rating |
| 11* | — | 0.14 | Compound 34 | 0.4 | 1 |
| 12 | Compound 7 | 0.35 | Compound 34 | 0.4 | 5 |
| 13 | Compound 7 | 0.58 | Compound 34 | 0.4 | 5 |
| 14 | Compound 45 | 0.35 | Compound 34 | 0.4 | 5 |
| 15 | Compound 45 | 0.58 | Compound 34 | 0.4 | 5 |
| 16 | Compound 34 | 0.35 | Compound 34 | 0.4 | 5 |
| 17 | Compound 34 | 0.58 | Compound 34 | 0.4 | 5 |
| 18* | — | 0.14 | Compound 34 | 0.61 | 2 |
| 19* | — | 0.14 | Compound 34 | 0.84 | 2 |

* comparison

It is evident from Table 2 that photosensitive materials within the scope of the invention are effective for suppressing interference fringes.

There has been described a photothermographic material which produces an image containing minimized interference fringes.

Reasonable modifications and variations are possible from the foregoing disclosure without departing from either the spirit or scope of the present invention as defined by the claims.

We claim:

1. A photothermographic material comprising:

a support having a first surface and a second surface, and a photosensitive silver halide emulsion layer, which is to be exposed to laser light having a wavelength of less than 700 nm, on said first surface of said support, wherein the silver halide of said photosensitive silver halide emulsion layer has a grain size of up to 0.1 μm and is spectrally sensitized by a sensitizing dye having a spectral sensitivity that corresponds to the spectral properties of said laser light, said photosensitive silver halide emulsion layer further comprises an organic silver salt, a reducing agent for the organic silver salt, and at least one dye, and said photographic silver halide emulsion layer has an absorbance of at least 0.3 at the exposure wavelength, said wavelength being less than 700 nm, wherein the photothermographic material further comprises at least one back layer disposed on said second surface of the support, said at least one back layer having an absorbance of at least 0.2 at the exposure wavelength, said wavelength being less than 700 nm.

2. The photothermographic material of claim 1 which is to be exposed by means of a laser scanning exposure apparatus which directs scanning laser light to a surface of the photothermographic material at an angle which is not substantially perpendicular to the surface, said photothermographic material producing images with minimized interference fringes.

3. The photothermographic material of claim 1 which is to be exposed by means of a laser scanning exposure apparatus which emits scanning laser light in a longitudinal multiple mode, said photothermographic material producing images with minimized interference fringes.

4. The photothermographic material of claim 1 wherein the absorbance of the photosensitive silver halide emulsion layer is in the range of from 0.3 to 1.2.

5. The photothermographic material of claim 1 wherein the absorbance of said at least one back layer is in the range of from 0.3 to 2.

6. The photothermographic material of claim 1 wherein the grain size of the silver halide is from 0.01 μm to 0.08 μm.

7. The photothermographic material of claim 1 wherein the grain size of the silver halide is from 0.02 μm to 0.06 μm.

8. The photothermographic material of claim 1, wherein said laser light having a wavelength of from 115 nm to 690 nm.

9. The photothermographic material of claim 1, wherein the photosensitive silver halide is present in an amount of 0.03 to 0.25 mol per mol of the organic acid salt.

10. The photothermographic material of claim 1, wherein said organic silver salt is a long chain aliphatic carboxylic acid having 15–28 carbon atoms.

11. The photothermographic material of claim 1, wherein said organic silver salt is a silver salt of organic compounds having a carboxylic group.

12. The photothermographic material of claim 1, wherein said sensitizing dye is added in the amount of from 1 mg to 2 grams per square meter of photosensitive material.

* * * * *